US009573758B2

(12) United States Patent
Mullet et al.

(10) Patent No.: US 9,573,758 B2
(45) Date of Patent: Feb. 21, 2017

(54) TRASH COLLECTION ASSEMBLY

(71) Applicant: E-Pak Manufacturing, LLC, Wooster, OH (US)

(72) Inventors: Anthony F. Mullet, Huntersville, NC (US); Bryan S. Mullet, Wooster, OH (US); Joshua A. Mullet, Wooster, OH (US); James S. Arnold, Canal Fulton, OH (US)

(73) Assignee: E-Pak Manufacturing, LLC, Wooster, OH (US)

( * ) Notice: Subject to any disclaimer, the term of this patent is extended or adjusted under 35 U.S.C. 154(b) by 0 days.

(21) Appl. No.: 14/796,325

(22) Filed: Jul. 10, 2015

(65) Prior Publication Data

US 2017/0009512 A1 Jan. 12, 2017

(51) Int. Cl.

| | |
|---|---|
| ***B65F 1/14*** | (2006.01) |
| ***B65F 1/16*** | (2006.01) |
| ***E06B 5/02*** | (2006.01) |
| ***E05F 17/00*** | (2006.01) |
| ***E06B 3/32*** | (2006.01) |
| ***E06B 3/34*** | (2006.01) |
| ***B65F 1/12*** | (2006.01) |

(52) U.S. Cl.

CPC ..... *B65F 1/1452* (2013.01); *B65F 1/122* (2013.01); *B65F 1/1426* (2013.01); *B65F 1/1623* (2013.01); *E05F 17/00* (2013.01); *E06B 3/325* (2013.01); *E06B 3/34* (2013.01); *E06B 5/02* (2013.01); *B65F 2001/1653* (2013.01)

(58) Field of Classification Search

CPC ..... B65F 1/1426; B65F 1/16; B65F 1/1452; B65F 1/1623; B65F 1/1646; B65F 1/122; B65F 2001/1653; E06B 3/325; E06B 5/02; E06B 11/022; E05F 17/00; E04H 17/18

USPC ..... 52/DIG. 14; 220/822–824; 414/406

See application file for complete search history.

(56) References Cited

U.S. PATENT DOCUMENTS

| | | | | | |
|---|---|---|---|---|---|
| 3,378,323 | A * | 4/1968 | Goldberg | B65F 1/1426 | 211/83 |
| 3,612,638 | A * | 10/1971 | Healy | B65F 1/1426 | 232/43.2 |
| 5,577,672 | A * | 11/1996 | Holmes | B02C 18/02 | 241/14 |
| 6,123,497 | A * | 9/2000 | Duell | B65F 3/043 | 414/406 |
| 6,402,223 | B2 * | 6/2002 | Ser | B65D 88/126 | 296/100.07 |
| 6,978,576 | B2 * | 12/2005 | Shirk | E05D 3/022 | 220/908 |
| 8,668,186 | B1 * | 3/2014 | Wagner | B65F 1/1426 | 256/25 |
| 9,273,485 | B2 * | 3/2016 | Goode | E04H 17/18 | |
| 2002/0008403 | A1 * | 1/2002 | Ser | B65D 88/126 | 296/100.08 |

(Continued)

*Primary Examiner* — Robert Canfield

(74) *Attorney, Agent, or Firm* — Sand & Sebolt

(57) ABSTRACT

A trash collection assembly may include a dumpster housing which may house therein a dumpster to provide a more desirable aesthetic appeal. A garbage truck may be configured to lift the dumpster out of the dumpster housing without the need for the garbage truck driver to get out of the truck. A cover of the dumpster may open and close automatically respectively during the removal of the dumpster from the housing and return of the dumpster to the housing.

19 Claims, 8 Drawing Sheets

(56) References Cited

U.S. PATENT DOCUMENTS

| | | | | |
|---|---|---|---|---|
| 2011/0089179 | A1* | 4/2011 | Flewelling | B65F 1/006<br>220/524 |
| 2013/0277633 | A1* | 10/2013 | Goode | E04H 17/18<br>256/25 |
| 2014/0209605 | A1* | 7/2014 | Spahmann | B65F 1/163<br>220/264 |
| 2015/0028032 | A1* | 1/2015 | Flewelling | B65F 1/1426<br>220/263 |

* cited by examiner

TRASH COLLECTION ASSEMBLY

BACKGROUND

Technical Field

The technical field relates to methods and systems for trash collection. The technical field may more particularly relate to such methods and systems involving a dumpster and a dumpster housing in which the dumpster may be disposed.

Background Information

The use of garbage trucks is well known for emptying dumpsters filled with trash or garbage. In some cases, fences or the like have been used to hide dumpsters to provide a more aesthetic appearance. For instance, a dumpster may be positioned within a fenced-in area or other structure which has a garbage truck access gate allowing people to enter the fenced-in area to place trash in the dumpster, and also to allow a garbage truck to approach the dumpster when the gate is open. One drawback related to this type of system is that it requires the garbage truck driver or operator to exit the truck to open the gate prior to lifting and emptying the dumpster and again getting out of the truck to close the gate afterward. Thus, while the housing or fenced-in area may provide a more aesthetic appeal, the additional effort and time required to empty the dumpster is increased relative to the time required to empty a dumpster which is not enclosed in such a fence or housing.

SUMMARY

In one aspect, an apparatus may comprise a dumpster housing having a sidewall which defines a dumpster-receiving interior chamber and has a top edge defining a top entrance opening of the interior chamber; and left and right lift-receiving through openings which are formed in the sidewall in communication with the interior chamber and atmosphere outside the housing, which extend downwardly from the top edge of the sidewall and which are adapted to respectively receive therethrough left and right forks of a lift.

In another aspect, an apparatus may comprise a dumpster housing defining a dumpster-receiving interior chamber adapted to house therein a dumpster; a housing cover of the dumpster housing having an open position and a closed position in which the cover extends over the interior chamber; a dumpster engagement member within the interior chamber adapted to engage the dumpster; and a linkage unit operatively connected to the cover and dumpster engagement member such that the dumpster engagement member moves in response to movement of the cover between the open and closed positions.

In another aspect, an apparatus may comprise a dumpster housing defining a dumpster-receiving interior chamber which is adapted to house therein a dumpster; a front panel of the dumpster housing which is movable between a home position and a deployed position; a dumpster engagement member within the interior chamber adapted to engage the dumpster; and a linkage unit operatively connected to the front panel and dumpster engagement member such that the dumpster engagement member moves in response to movement of the front panel between the home and deployed positions.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims.

Similar numbers refer to similar parts throughout the drawings.

DETAILED DESCRIPTION

Figure 4:
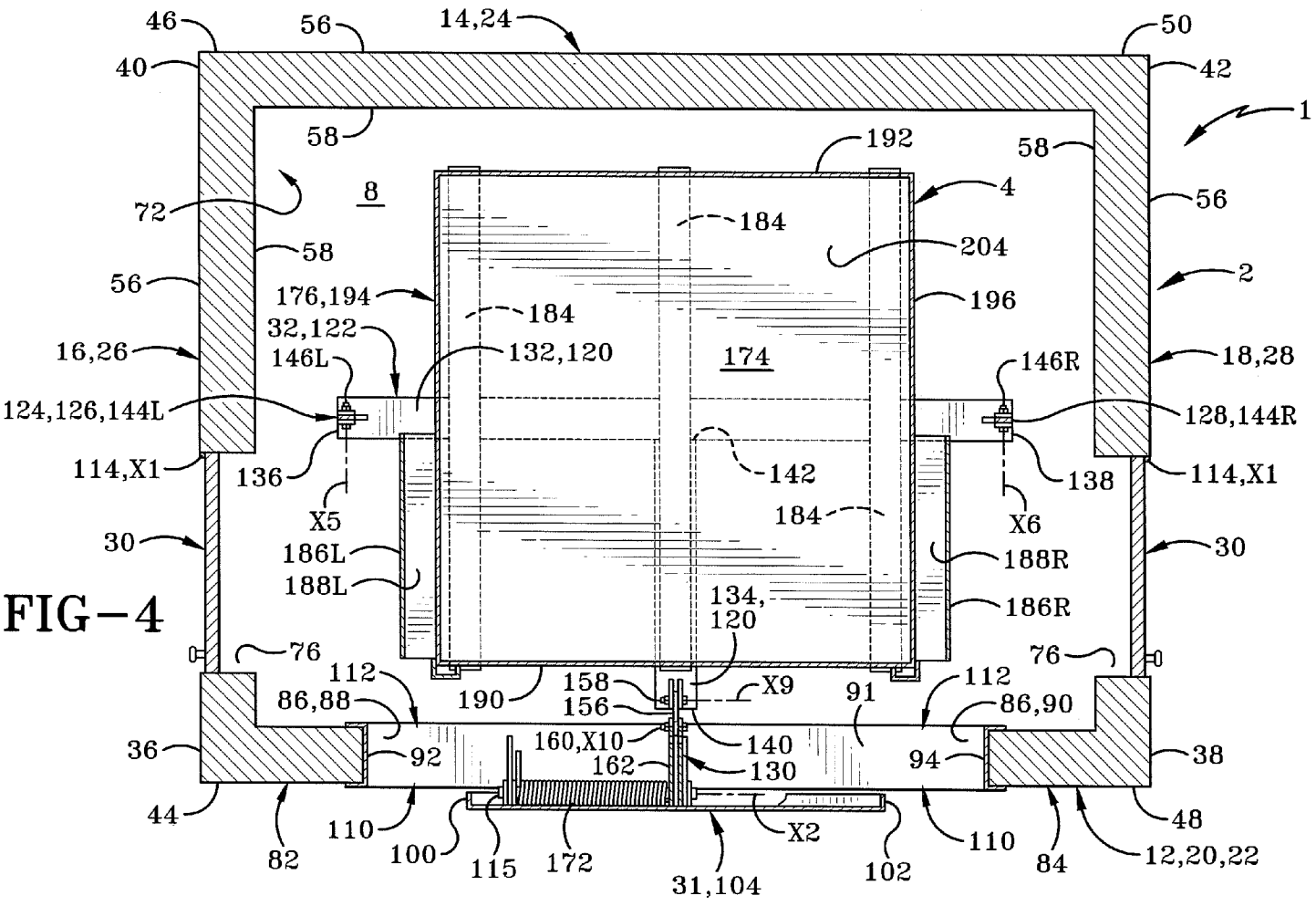
FIG. 4 is a sectional view taken on line 4-4 of FIG. 2 looking downward and providing a sectional view of the dumpster housing and dumpster in the dumpster housing.
Figure 5:
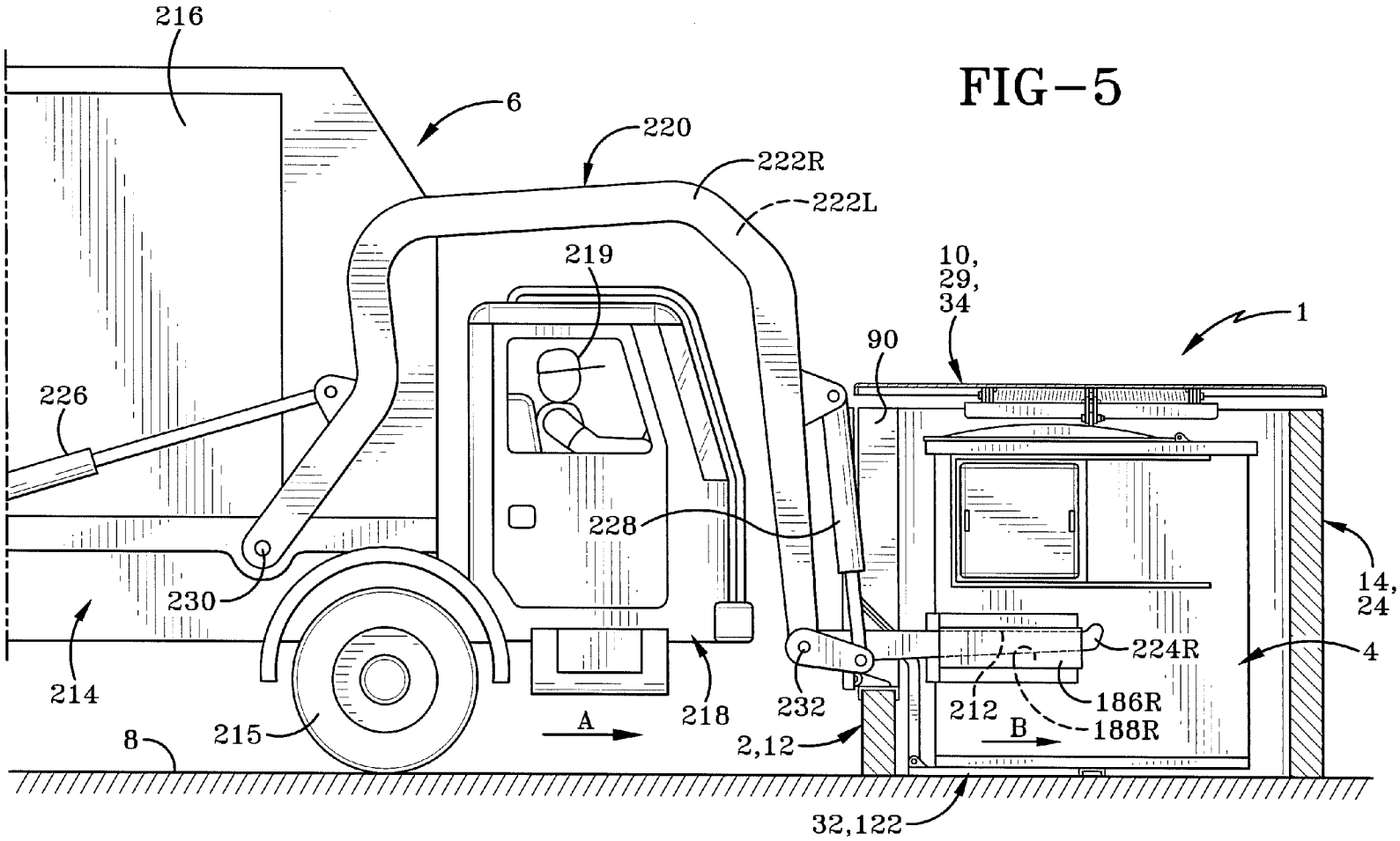
FIG. 5 is a right side elevation view of a garbage truck with garbage truck lift forks engaging the dumpster inside the dumpster housing, with the dumpster and dumpster housing shown similar to FIG. 3.
Figure 8:
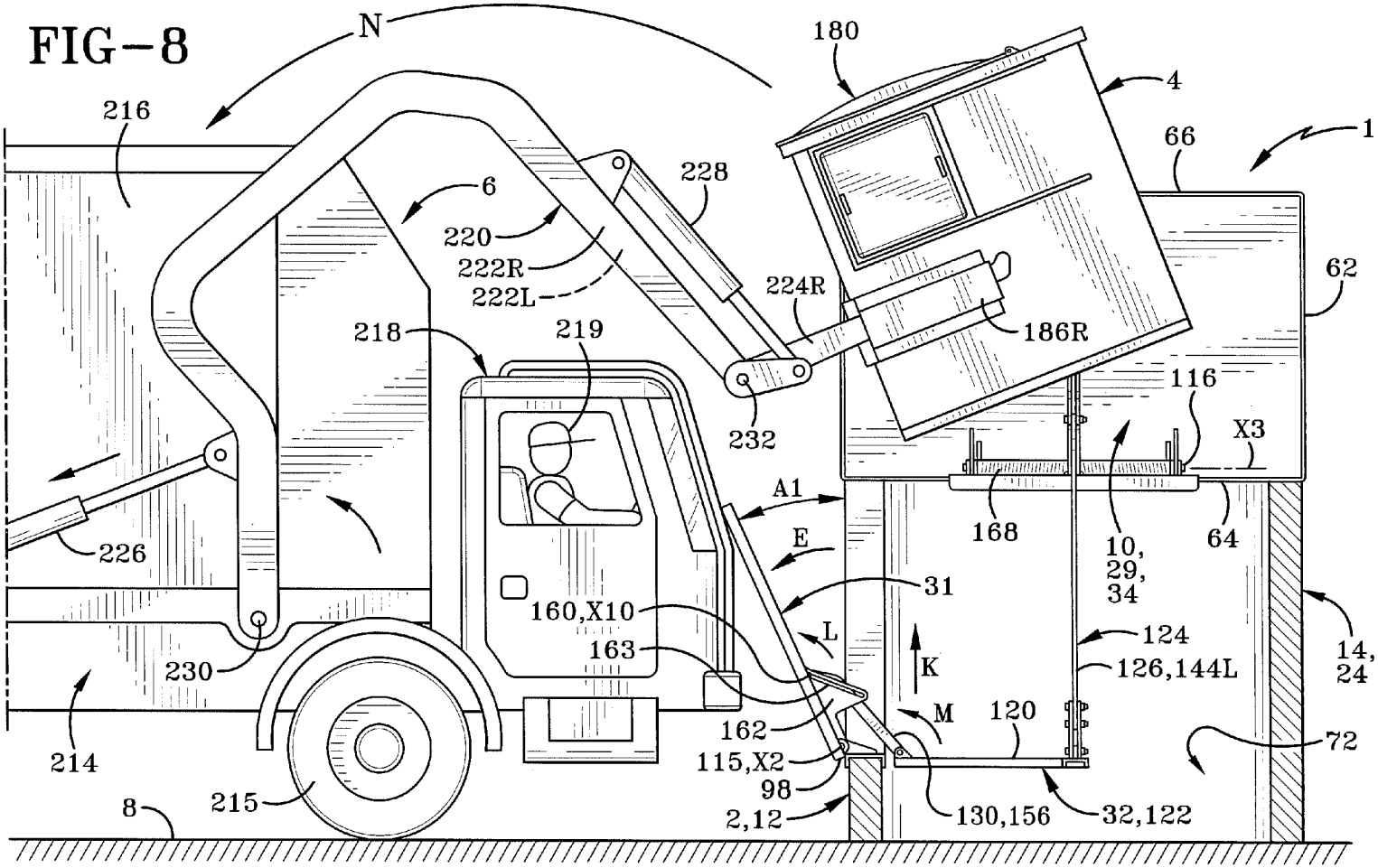
FIG. 8 is similar to FIG. 5 and shows the dumpster having been lifted out of the interior chamber of the dumpster housing to a position between the cover doors in preparation for dumping the trash in dumpster into the trash receptacle of the garbage truck.

A trash collection system 1 may include a dumpster housing 2 (FIGS. 1-4), a dumpster 4 (FIGS. 2-4) and a garbage truck (FIGS. 5, 8). Housing 2 is typically seated on the ground 8 or other support surface and configured to house therein dumpster 4. Housing 2 may be configured to allow a garbage truck to remove dumpster 4 from within housing 2 in order to dump the trash into the garbage truck and return dumpster 4 into housing 2 without the operator or driver of the garbage truck exiting the truck throughout the process.

Figure 1:
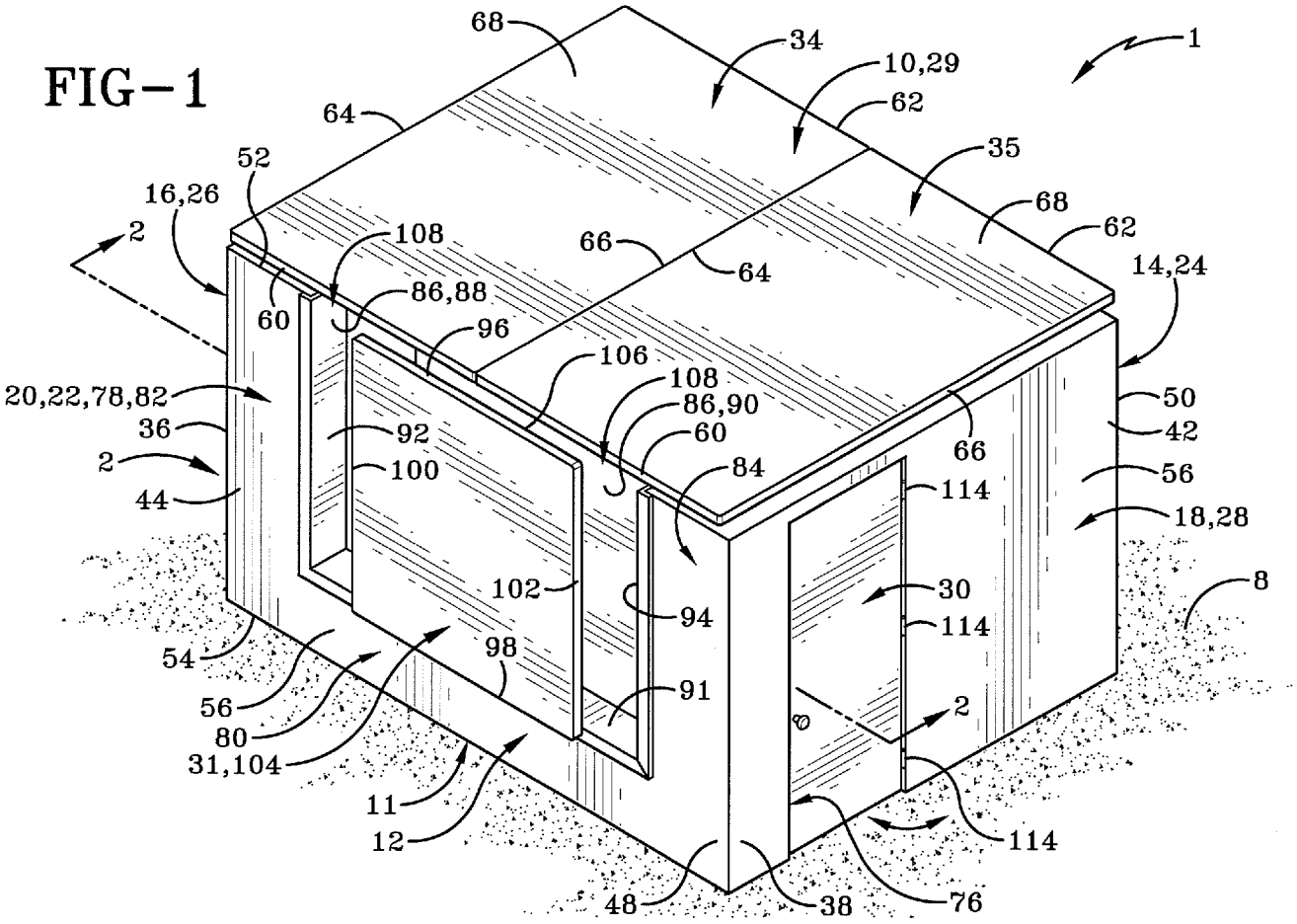
FIG. 1 is an isometric view of a dumpster housing with a dumpster therein and with various doors in closed positions and a front panel in a home position.

With primary reference to FIG. 1, dumpster housing 2 may have a top 10, a bottom 11, a front and back 12 and 14 defining therebetween an axial direction of the housing, and left and right sides 16 and 18 defining therebetween a longitudinal direction of the housing. Housing 2 may include an upwardly extending sidewall 20 which extends around, surrounds or circumscribes dumpster 4 when dumpster 4 is disposed within the housing. Sidewall 20 may include an upwardly extending front wall 22 extending along or defining front 12, an upwardly extending back wall 24 extending along or defining back 14, an upwardly extending left wall 26 extending along or defining left side 16 and an upwardly extending right wall 28 extending along or defining right side 18. Front wall 22 may include a front panel 31. Housing 2 may further include a cover 29, one or more side doors 30 and an assembly 32 which may be referred to in various ways. For instance, mechanism or assembly 32 may be referred to as opening and closing mechanism or assembly; an opening mechanism or assembly; a closing mechanism or assembly; a cover door opening or closing mechanism or assembly; a weight-activated closing mechanism or assembly; a dumpster-engagement or engaging assembly; a linkage or linkage assembly; a door or panel closing or opening linkage or linkage assembly, and so forth. Cover 29 may include a first or left cover door 34 and a second or right cover door 35 which are movable relative to sidewall 20 and one another.

Front wall 22 may have left and right ends 36 and 38, back wall 24 may have left and right ends 40 and 42, left wall 26 may have front and back ends 44 and 46, and right wall 28 may have front and back ends 48 and 50. Left end 36 of front wall 22 may be secured to front end 44 of left wall 26 to form a vertical left front corner of housing 2. Right end 38 of front wall 22 may be secured to front end 48 of right wall 28 at a vertical front right corner of housing 2. Left end 40 of back wall 24 may be secured to back end 46 of left wall 26 at a vertical left rear corner of housing 2. Right end 42 of back wall 24 may be secured to back end 50 of right wall 28 at a vertical right rear corner of housing 2. Sidewall 20 may have a top or top edge 52 and a bottom or bottom edge 54 wherein top edge 52 and bottom edge 54 may also represent the top or top edges and bottom or bottom edges of front wall 22, back wall 24, left wall 26 and right wall 28.

Front and back walls 22 and 24 may be essentially parallel to one another, and left and right walls 26 and 28 may likewise be essentially parallel to one another and essentially perpendicular to front and back walls 22 and 24. Sidewall 20 may include an outer surface 56 which may also serve as the outer surfaces of walls 22-28. Likewise, sidewall 20 may have an inner surface 58 which likewise serves as the inner surfaces of walls 22-28. Top and bottom edges 52 and 54 may be essentially parallel to one another and essentially horizontal. Outer and inner surfaces. 56 and 58 may be essentially vertical. The outer and inner surface 56 and 58 of a given one of walls 22, 24, 26 and 28 may be essentially parallel to one another and essentially flat. Sidewall 20 may be essentially vertical whereby each of its walls 22, 24, 26 and 28 may likewise be essentially vertical.

Each of cover doors 34 and 35 may have front and back edges 60 and 62 which may be essentially parallel to one another, and left and right edges 64 and 66 which may be essentially parallel to one another and essentially perpendicular to front and back edges 60 and 62. The left edge 64 of door 34 may be referred to as an outer edge, while the right edge 66 of door 34 may be referred to as an inner edge. The left edge 64 of door 35 may be referred to as an inner edge, while the right edge 66 of door 35 may be referred to as an outer edge. Each of doors 34 and 35 may include an outer or top surface 68 which extends from the front edge 60 thereof to the back edge 62 thereof and from the left edge 64 thereof to the right edge 66 thereof. Likewise, each of doors 34 and 35 may include an inner or bottom surface 70 which extends from the front edge 60 thereof to the back edge 62 thereof and from the left edge 64 thereof to the right edge 66 thereof. Surfaces 68 and 70 may be essentially flat, essentially parallel to one another and essentially horizontal when doors 34 and 35 are in their closed positions.

FIG. 1 shows housing 2 with cover 29 in a housing cover closed position and cover doors 34 and 35 in housing cover door closed positions. In this closed position, edges 60, 62, 64 and 66 may be essentially horizontal. Each of front and back edges 60 and 62 may be longitudinally elongated in the closed position, while edges 64 and 66 may be axially elongated in the closed position. The front edges 60 of doors 34 and 35 may be aligned with one another so as to be essentially collinear in the closed position. Likewise, back edges 62 of doors 34, 35 may be aligned with one another to be essentially collinear in the closed position. In the closed position, left or outer edge 64 of left door 34 may extend along top edge 52 of left wall 26 from adjacent front end 44 to adjacent back end 46. Likewise, the right or outer edge 66 of right door 35 may extend along or adjacent top edge 52 of right sidewall 28 from adjacent front end 48 to adjacent back end 50. The back edge of cover 29, which in the sample embodiment is made up of back edges 62 of left and right doors 34 and 35, may extend along or adjacent top edge 52 of back wall 24 from adjacent left end 40 to adjacent right end 42. Each back end 62 may extend along or adjacent a portion of top edge 52 of back wall 24. This portion may be about half the longitudinal length of top edge 52 of back wall 24. The inner edges of doors 34 and 35, that is the right edge 66 of door 34 and the left edge 64 of door 35, may be in contact with or adjacent one another in the closed position.

Housing 2 defines a dumpster-receiving interior chamber 72 having a top entrance opening 74. Interior chamber 72 may be substantially rectangular or square as viewed from above, substantially square or rectangular as viewed from the front and substantially square or rectangular as viewed from the side. Interior chamber 72 may be defined by inner surface 58 of sidewall. 20, or the inner surfaces 58 of walls 22-28. Top entrance opening 74 may be defined by top edge 52 of sidewall 20 or the top edges 52 of walls 22-28. Cover doors 34 and 35 may essentially close top entrance opening 74 of interior chamber 72 in the closed position. In the closed position of cover 29, the cover blocks the entry or exit of dumpster 4 into or out of interior chamber 72.

Sidewall 20 may define one or more through openings or doorways 76 extending from outer surface 56 to inner surface 58. Each doorway 76 may extend from adjacent top edge 52 to adjacent bottom edge 54. The top of each doorway 76 may be spaced downwardly from top edge 52. The bottom of each doorway 76 may be at or adjacent and spaced upwardly from bottom edge 54. While the one or more doorways 76 may be formed in various of the walls of sidewall 20, a left doorway 76 may be formed in left wall 26 and a right doorway 76 may be formed in right wall 28 and may be formed more particularly in the front portion or front half of the respective wall 26 or 28. Such a location may provide easier access to a side trash door of dumpster 4 which is discussed further below.

Front wall 22 may include a front sidewall portion or front wall portion which may be a U-shaped (as viewed from the front) sidewall or front wall portion 78 comprising a base segment 80 which may be essentially horizontal, a left upwardly extending portion or upright 82 which may be essentially vertical, and a right upwardly extending portion or upright 84 which may be essentially vertical and essentially parallel to left portion or upright 82. Left portion 82 may be secured to the left end of segment 80 and extend upwardly therefrom. Similarly, right portion 84 may be secured to the right end of segment 80 and extend upwardly therefrom. Front wall 22 may define a front wall opening 86 which extends from left upright 82 to right upright 84 above base segment 80. Through opening 86 may extend upwardly to top edge 52 of front wall 22 and may be covered by front portions of doors 34 and 35 in the closed position. Opening 86 may extend from outer or front surface 56 of front wall 22 to inner or back surface 58 of front wall 22. Opening 86 may include a left fork or arm-receiving opening 88 and a right fork or arm-receiving opening 90 each defined by sidewall 20/front wall 22 such that openings 88 and 90 are laterally spaced from one another or horizontally spaced from one another (in the longitudinal direction). Left opening 88 may be adjacent and to the right of left upright 82. Right opening 88 may be adjacent and to the left of right upright 84. Base segment 80 may have an upwardly facing top side, surface or edge 91. Left upright 82 may have an essentially vertical rightward facing right side, surface or edge 92. Right upright 84 may have an essentially vertical leftward facing left side, surface or edge 94. Edges or surfaces 91, 92 and 94 may bound and essentially define front wall opening 86 such that opening 86 extends laterally from right edge 92 to left edge 94 and upwardly from top edge 91 to top edge 52 of front wall 22/uprights 82, 84. Each of opening 88 and 90 may extend through sidewall 20/front wall 22 to provide communication between interior chamber 72 and atmosphere external to dumpster housing 2 or sidewall 20. Each opening 88, 90 may be vertically elongated and may have a vertical length which is defined between the top and bottom of the given opening (or between surface 91 and top edge 52 or top edge 96) and which may be at least ⅓, ½ or ⅔ the vertical length or height of sidewall 20, front wall 22 or uprights 82 and 84 defined between the respective tops and bottoms thereof (or between bottom edge 54 and top edge 52).

Front panel 31 may be connected to base segment 80 and extend upwardly therefrom between uprights 82 and 84. Front panel 31 may have an essentially horizontal top edge 96, an essentially horizontal bottom edge 98, and essentially vertical left and right edges 100 and 102 which extend from top edge 96 to bottom edge 98. Panel 31 may include a front or outer surface 104 which may face away from interior chamber 72 and opening 86, and a back or inner surface 106 which may face interior chamber 72 and opening 86. Bottom edge 98 may be adjacent and parallel to top edge 91 of base segment 80. Top edge 96 may be about the same height as top edge 52 of front wall 22. Top edge 96 may also be closely adjacent or in contact with inner or bottom surface 70 of each door 34 and 35 adjacent front edges 60 in their closed positions.

Figure 3:
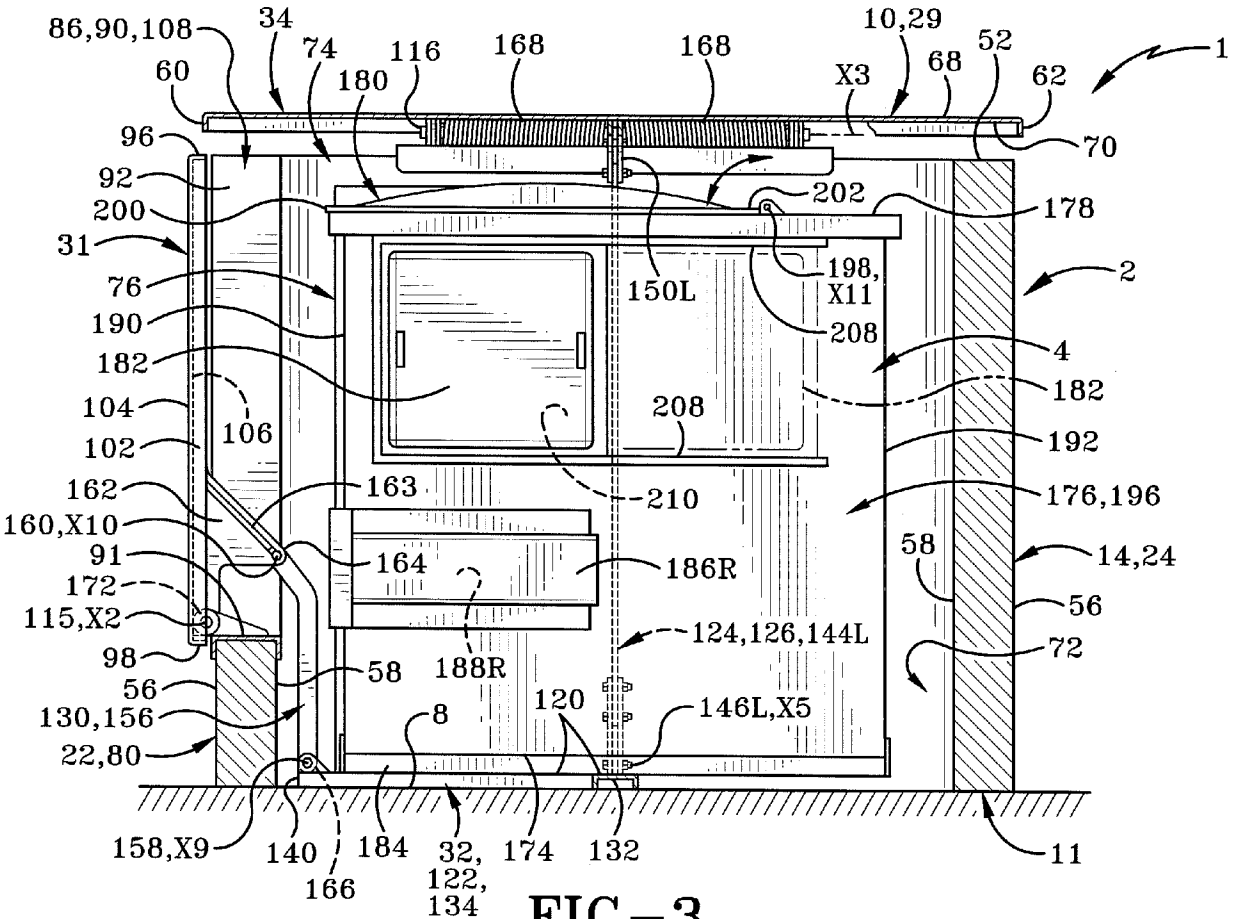
FIG. 3 is a view taken on line 3-3 of FIG. 2 looking to the left and providing a sectional view of the dumpster housing and a right side elevation view of the dumpster in the dumpster housing.

Front panel 31 may be movable between a first or home position shown in FIGS. 1, 3 and 4 and a second position shown in FIG. 8. The first or home position of panel 31 may also be called a closed position, a rearward position or a retracted position. The second or deployed position of panel 31 may also be called a partially open position, a forward position or an extended position. In the home or deployed position of panel 31, left lift arm opening 88 may be defined between right edge 92 of left upright 82 and left edge 100 of panel 31 and may extend upwardly from top edge 91 along the entire vertical length of edges 92 and 100 to top edges 52 and 96. In the home or deployed position of panel 31, right lift arm opening 90 may be defined between left edge 94 of right upright 84 and right edge 106 of panel 31 and may extend upwardly from the top edge 91 along the entire vertical length of edges 94 and 102 to top edges 52 of front wall 22 and top edge 96 of panel 31. Each of openings 88 and 90 are through openings extending from the front or outer surface 56 of front wall 22 to the inner or back surface 58 of front wall 22. Each opening 88 and 90 may have a top or top entrance opening 108, a front or front entrance opening 110 and a back or back entrance opening 112.

The top or top entrance opening 108 of opening 88 may be defined between top edge 52 of upright 82 and top edge 96 of panel 31, and may more particularly be defined between the upper right corner of left upright 82 and the upper left corner of panel 31. The top or top entrance opening 108 of opening 90 may be defined between top edge 52 of right upright 84 and top edge 96 of panel 31, and may more particularly be defined between the top left corner of upright 84 and the top right corner of panel 31. The front entrance opening 110 of opening 88 may be defined between the outer or front surface 56 of left upright 82 and the front or outer surface 104 of panel 31 along left edge 100, or between the vertical front right corner of left upright 82 and the vertical front left corner of panel 31. The front entrance opening 110 of opening 90 may be defined between the front or outer surface 52 of right upright 84 and the front or outer surface 104 of panel 31, or between the vertical front left corner of upright 84 and the vertical front right corner of panel 31. Back entrance opening 112 of opening 88 may extend along and to the right of inner or back surface 58 of left upright 82 or to the right of and adjacent the vertical right rear corner of upright 82. Back entrance opening 112 of opening 90 may extend adjacent and to the left of inner or back surface 58 of right upright 84 or adjacent and to the left of the vertical left rear corner of upright 84. In the closed position of doors 34 and 35, a front portion of door 34 adjacent front edge 60 thereof may extend over or cover the top or top entrance opening 108 of left opening 88, and a front portion of door 35 adjacent front edge 60 thereof may extend over or cover the top or top entrance opening 108 of right opening 90.

Each of doors 30, 34 and 35 and panel 31 may be pivotally mounted about respective hinges or pivots to pivot about respective axes between respective open and closed positions or between home and deployed positions. More particularly, each door 30 may be pivotally mounted on sidewall 20 (such as on left or right walls 26 or 28) by a hinge or pivot 114 to pivot relative to sidewall 20 between open and closed positions (as represented by a double headed arrow in FIG. 1) about an essentially vertical axis X1 (FIG. 4) of pivot 114. While panel 31 may be rigidly secured to base segment 80 and extend upwardly therefrom in a fixed position relative to base segment 80, panel 31 may also be pivotally mounted on base segment 80 of front wall 22 of sidewall 20 via a hinge or pivot 115 (FIGS. 3, 4) to pivot relative to sidewall 20/front wall 22 between the front panel home and deployed position about an axis X2 of pivot 115 which may be essentially horizontal and may extend longitudinally or in the longitudinal direction or from left to right. Pivot 115 and axis X2 may be adjacent the bottom or bottom edge 98 of panel 31, adjacent top edge 91 of segment 80, adjacent front surface 56 of base segment 80/front wall 22, and adjacent an essentially horizontal front top corner of base segment 80. Top edge 96 may thus move away from interior chamber 72 and front wall opening 86 while pivoting from the front panel closed or home position toward the front panel partially open or deployed position, and may move toward interior chamber 72 and opening 86 while pivotally moving from the front panel partially open or deployed position to the front panel closed or home position.

In the front panel home position, panel 31 may be essentially vertical, as may be outer and inner surfaces 104 and 106 and left and right edges 100 and 102, while top and bottom edges 96 and 98 may be essentially horizontal. In the front panel deployed position, panel 31 may angle forward and upward, as may outer and inner surfaces 104 and 106 and left and right edges 100 and 102, while top and bottom edges 96 and 98 may be essentially horizontal. Top edge 96 may be within or closely adjacent opening 88 in the panel home position. Top edge 96 may be distal and spaced forward of opening 88 in the panel deployed position. Top edge 96 in the panel deployed position may be in a location which is forward of and lower than the location of top edge 96 in the panel home position.

Panel 31 may have a tilted angle A1 as viewed from the side (or in the longitudinal direction) which may also represent the angle between panel 31 in the deployed and home position. More particularly, angle A1 may be defined between the orientation of one of surfaces 104 and 106 or edges 100 and 102 in the panel home position and the orientation of one of surfaces 104 and 106 or edges 100 and 102 in the panel deployed position. Angle A1 may also be defined between vertical and one of surfaces 104 and 106 or edges 100 and 102 in the panel deployed position. Angle A1 may also be defined between one of outer and inner surfaces 56 and 58 of front wall 22 and one of surfaces 104 and 106 or edges 100 and 102 in the panel deployed position. Angle A1 may be within a range of about 5, 10 or 15 degrees to about 20, 25, 30, 35, 40 or 45 degrees.

Left cover door 35 may be pivotally mounted on sidewall 20/left wall 26 by a hinge or pivot 116 to pivot about an essentially horizontal axis X3 of pivot 116 between left housing cover door open and closed positions. Pivot 116 and axis X3 may be adjacent the left or outer edge 64 of left cover door 34 and adjacent top edge 52 of left wall 26. Axis X3 may extend axially or in the axial direction or from front to back. Right or inner edge 66 of left door 34 may move upwardly and to the left away from interior chamber 72 and entrance opening 74 thereof when moving from the left housing cover door closed position (FIGS. 1-3) to the left housing cover door open position (FIG. 7) while outer left edge 64 remains adjacent top edge 52 of left wall 26. Inner or right edge 66 of door 34 may move to the right and downward toward chamber 72 and entrance opening 74 as door 34 moves from its open position to its closed position.

Right cover door 35 may be pivotally mounted on sidewall 20/right wall 28 by a hinge or pivot 117 to pivot between a right cover door closed position (FIGS. 1-3) and right cover door open position (FIG. 7) about an axis X4 of pivot 117 which may be essentially horizontal and which may extend axially or in the axial direction or from front to rear. Axes X3 and X4 may be essentially parallel to one another and may be essentially perpendicular to axis X1 and axis X2. Axis X2 may be essentially perpendicular to axis X1. Left or inner edge 64 of right cover door 35 may move upwardly and to the right away from interior chamber 72 and entrance opening 74 as it pivots from its closed position to its open position while right or outer edge 66 of door 35 remains adjacent top edge 52 of right wall 28. Inner or left edge 64 of right door 35 may move downwardly and to the left toward chamber 72 and entrance opening 74 as door 35 pivots from its open position to its closed position. The inner edges of doors 34 and 35 (i.e. right edge 66 of door 34 and left edge 64 of door 35) may move away from one another as doors 34 and 35 move from their closed positions to their open positions, and may move toward one another as doors 34 and 35 move from their open positions to their closed positions. The right front corner of left door 34 or the front portion of right/inner edge 66 of left door 34 adjacent its front edge 60 may move away from top edge 96 of panel 31 and away from panel 31 during the pivotal movement of door 34 from its closed position to its open position, and toward edge 96 and panel 31 during pivotal movement of door 34 from its open position to its closed position. Similarly, the front left corner of right door 35 or the front portion of inner/left edge 64 of door 35 adjacent its front edge 60 may move away from top edge 96 and panel 31 during pivotal movement of door 35 from its closed position to its open position, and toward edge 96 and panel 31 during pivotal movement of door 35 from its open position to its closed position.

This paragraph describes relative positions or relationships of various components which may exist in the housing cover closed position of cover 29 and housing cover door closed positions of door 34 and 35. Each door 34 and 35 may be essentially horizontal, as may be upwardly facing outer/top surface 68, downwardly facing inner/bottom surface 70, and edges 60, 62, 64 and 66. Edge 66 of left door 34 and edge 64 of right door 35 may be adjacent top entrance opening 74 and top edge 52 of sidewall 20 and top edge 96 of panel 31 (for instance, such that edge 66 of left door 34 adjacent back edge 62 of left door 34 is adjacent top edge 52 of back wall 24, edge 64 of right door 35 adjacent back edge 62 of right door 35 is adjacent top edge 52 of back wall 24, edge 66 of left door 34 adjacent front edge 60 of left door 34 is adjacent top edge 96 of panel 31, and edge 64 of right door 35 adjacent front edge 60 of right door 35 is adjacent top edge 96 of panel 31). When panel 31 is in the panel home position, top edge 96 may be adjacent or in contact with cover doors 34 and 35, such as adjacent or in contact with front edges 60 or bottom surface 70 adjacent front edges 60.

This paragraph describes relative positions or relationships of various components which may exist in the housing cover open position of cover 29 or housing cover door open position of cover doors 34 and 35. Each door 34 and 35 may extend upwardly and may be essentially vertical, as may be outer surfaces 68 (with outer surface 68 of left door 34 serving as a left or leftward facing surface and outer surface 68 of right door 35 serving as a right or rightward facing surface), inner surfaces 70 (with inner surface 70 of left door 34 serving as a right or rightward facing surface and inner surface 70 of right door 35 serving as a left or leftward facing surface) and front and back edges 60 and 62, while edges 64 and 66 may be essentially horizontal (with outer edge 64 of left door 34 serving as a bottom or downward facing edge, inner edge 66 of left door 34 serving as a top or upward facing edge, inner edge 64 of right door 35 serving as a top or upward facing edge and outer edge 66 of right door 35 serving as a bottom or downward facing edge). Inner surfaces 68 of doors 34 and 35 may face one another while outer surfaces 70 may face away from one another. The inner edges or top edges of doors 34 and 35 (i.e., edge 66 of left door 34 and edge 64 of right door 35) may be distal one another and define therebetween a normal horizontal distance D1 (FIG. 7) measured in the longitudinal direction of a dumpster-receiving space 118 defined between said edges. Edge 66 of left door 34 and edge 64 of right door 35 may be distal and spaced upwardly of top edge 52 of sidewall 20, top entrance opening 74 and top edge 96 of panel 31 (for instance, such that edge 66 of left door 34 adjacent back edge 62 of left door 34 is distal and spaced upwardly of top edge 52 of back wall 24, edge 64 of right door 35 adjacent back edge 62 of right door 35 is distal and spaced upwardly of top edge 52 of back wall 24, edge 66 of left door 34 adjacent front edge 60 of left door 34 is distal and spaced upwardly of top edge 96 of panel 31, and edge 64 of right door 35 adjacent front edge 60 of right door 35 is distal and spaced upwardly of top edge 96 of panel 31).

Assembly 32 may have a dumpster-seating surface or dumpster-engagement surface 120 which may be in contact with dumpster 4 when dumpster 4 is within interior chamber 72 especially with doors 34 and 35 in their closed positions and panel 31 in its closed position, and out of contact with dumpster 4 when dumpster 4 is removed from or external to interior chamber 72. Surface 120 may be an upwardly facing surface of a base, platform, dumpster engagement member or dumpster support 122. Assembly 32 may further include a linkage assembly 124 which is operatively connected to or interlinked with dumpster engagement member or support 122, doors 34 and 35 and panel 31 so that movement of any of member or support 122, doors 34 and 35 and panel 31 either causes movement or moves in response to movement of another one of these components, namely member/support 122, doors 34 and 35 and panel 31. Linkage assembly 124 may include a first or left linkage unit 126, a second or right linkage unit 128 and a third or front linkage unit 130. Linkage assembly 124 including left linkage units 126 and 128, along with member 122, may hang from cover 29/cover doors 34 and 35. Linkage unit 130 and member 122 may hang from panel 31. Linkage unit 126 may extend between and be operatively connected to or interlinked with cover door 34 and member 122. Linkage unit 128 may extend between and be operatively connected to or interlinked with cover door 35 and member 122. Linkage unit 130 may extend between and be operatively connected to or interlinked with panel 31 and member 122.

Figure 7:
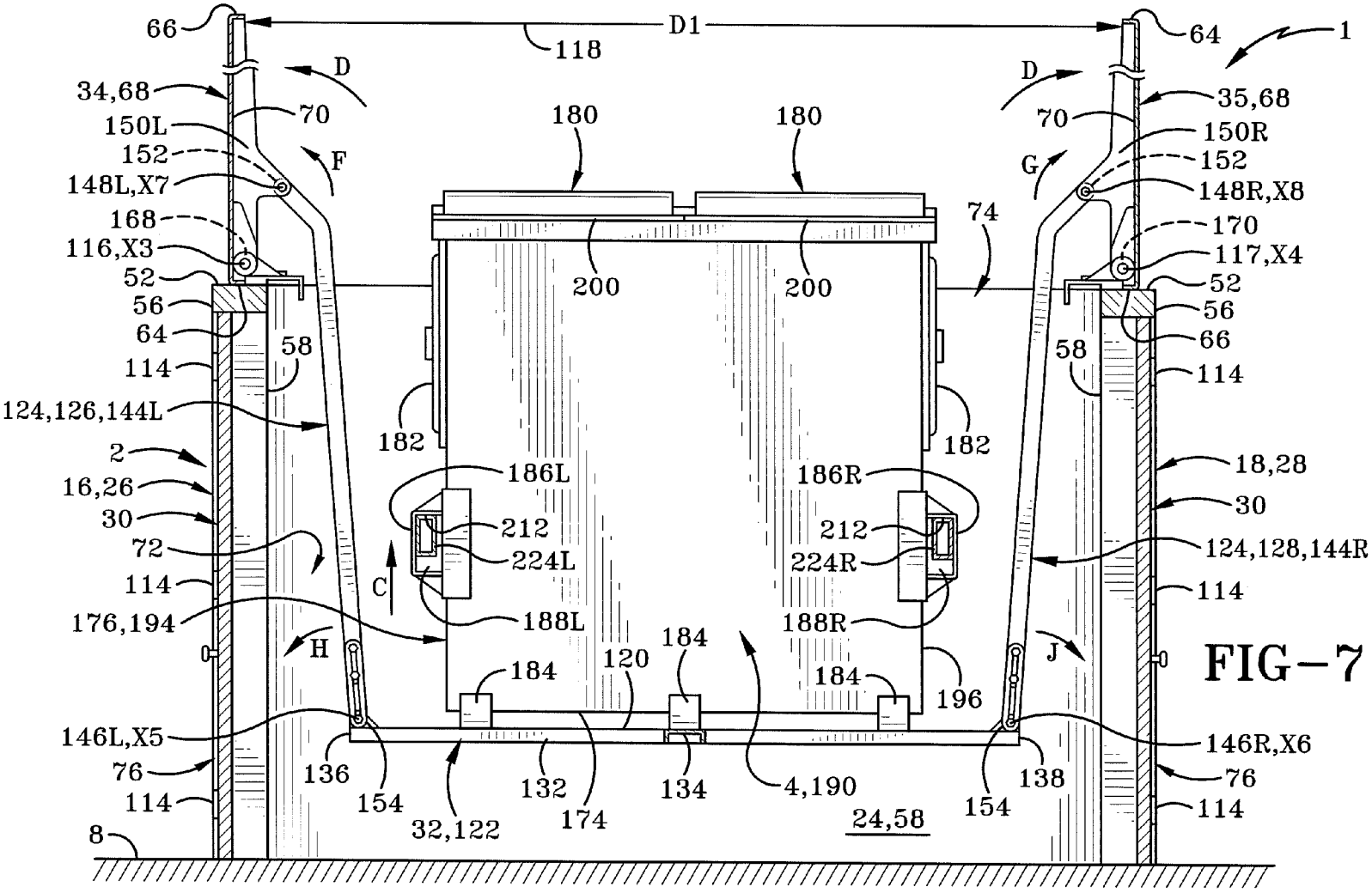
FIG. 7 is similar to FIG. 6 and shows a subsequent stage of lifting the dumpster such that the dumpster has been lifted a greater vertical distance, such that the cover doors are in their open positions, and such that the left and right linkage units and dumpster engagement member have moved upwardly a greater vertical distance.

Base or dumpster support 122 may have a variety of configurations as will be understood from additional description herein. In a sample embodiment, support 122 may include a first beam 132 and a second beam 134 which is secured to beam 132. First beam 132 may have left or right ends 136 and 138, and second beam 134 may have front and back ends 140 and 142. Left and right ends 136 and 138 of beam 132 may serve as the left and right ends of support 122. Second beam 134 adjacent back end 142 may be rigidly secured to and extend forward from a central or other portion of beam 132. Support 132 may be entirely within interior chamber 72 in all of its positions, including a lowered position (FIGS. 2-5) and a raised position (FIGS. 7, 8). The bottom of support 120 and beams 132 and 134 may be closely adjacent or in contact with ground 8 when support 120 is in its lowered position. Left end 136 may be adjacent and spaced to the right of inner surface 58 of left wall 26 in all of the positions of support 122. Likewise, right end 138 may be adjacent and spaced to the left of inner surface 58 of right wall 28 in all of the positions of support 122. In the lowered position of support 122, front end 140 of beam 134 and support 122 may be adjacent and spaced rearwardly of inner or back surface 58 of base segment 80/front wall 22, and front end 140 and support 122 in its entirety may be lower than top surface or edge 91 of base segment 80 and adjacent or within the bottom portion of interior chamber 72. In the raised position of support 122, support 122 in its entirety including beams 132 and 134 and the various ends thereof may be higher than surface 91.

Left linkage unit 126 may include a link 144L which may be essentially an upright or upwardly extending rod or the like, a lower pivot 146L, an upper pivot 148L and a mounting bracket 150L. Right linkage unit 128 may be essentially a mirror image of left linkage unit 126, and may include a similar link 144R, lower pivot 146R, upper pivot 148R and mounting bracket 150R. Each of the left and right links 144 may have a top end 152 and a bottom end 154. Link 144L may be pivotally connected adjacent its bottom end 154 to support 122/beam 132 adjacent the left end or side 136 via left lower pivot 146L thereof whereby link 144L is pivotable relative to support 122 about an axis X5 of pivot 146L which may be essentially horizontal and extend in the axial direction. Similarly, right link 144R may be pivotally connected adjacent its bottom end 154 to support 122/beam 132 adjacent the right end or side 138 thereof at right lower pivot 146R so that link 144R is pivotable relative to support 122 about an axis X6 of pivot 146R which may be essentially horizontal and extend in the axial direction. Left link 144L adjacent its top or upper end 152 may be pivotably connected to left mounting bracket 150L and left door 34 at left upper pivot 148L so that left cover door 34 is pivotable relative to left link 144L about an axis X7 of pivot 148L which may be essentially horizontal and extend in the axial direction. Similarly, right link 144R adjacent its upper or top end 152 may be pivotably connected to right bracket 150R and right cover door 35 at right upper pivot 148R so that right door 35 is pivotable relative to link 144R about an axis X8 of pivot 148R which may be essentially horizontal and extend in the axial direction. Axes X5, X6, X7 and X8 may be essentially parallel to one another and axes X3 and X4, essentially perpendicular to axis X2 and essentially perpendicular to axis X1.

Left bracket 150L may be rigidly secured to and extend downwardly from inner surface 70 of left door 34 in its closed position. Likewise, right mounting bracket 150R may be rigidly secured to and extend downwardly from inner surface 70 of right door 35 in the closed position thereof. In the lowered position of support 122 and linkage units 126 and 128 and when the doors 34 and 35 are in their closed positions, lower ends 154 and lower pivots 146 may be adjacent ground 8 and the bottom or lower end of interior chamber 72, while upper ends 152 and upper pivots 148 may be adjacent the top or top entrance opening 74 of interior chamber 72. In the lowered positions of support 122 and linkage assembly 124, upper ends 152 and upper pivots 148 may be within interior chamber 72 adjacent entrance opening 74 with left pivot 148L and upper end 152 of link 144L adjacent and spaced to the right of inner surface 58 of left wall 26, and upper end 152 of right link 144R and right upper pivot 148R adjacent and spaced to the left of inner surface 58 of right wall 28.

Front linkage unit 130 may include a link 156, lower and upper pivots 158 and 160 (FIGS. 3, 4) and a mounting bracket 162 which may be rigidly secured to and extend inwardly or rearwardly from inner or back surface 106 of panel 31. Bracket 162 may define an elongated slot 163 which, when panel 31 is in its home position, may be straight and elongated from a first or lower/back end of slot 163 upwardly and forward to a second or upper/front end of slot 163. Link 156 may have an upper or top end 164 and a lower or bottom end 166. Link 156 may be generally similar to links 144 although link 156 may be substantially shorter than each link 144. Link 156 adjacent lower end 166 may be pivotally connected to support 122/beam 134 adjacent front or front end 140 thereof at lower pivot 158 such that link 156 is pivotable relative to support 122 about an axis X9 of pivot 158 which may be essentially horizontal and extend in the longitudinal direction. Link 156 adjacent upper end 164 may be pivotably connected to bracket 162 and panel 31 at upper pivot 160 so that panel 31 is pivotable relative to link 156 about an axis X10 of pivot 160 which may be essentially horizontal and extend in the longitudinal direction. Axes X9 and X10 may be essentially parallel to one another and axis X2 and essentially perpendicular to axis X1 and axes X3-X8. When support 122 and linkage assembly 124 are in the lowered position and doors 34 and 35 and panel 31 are in their closed positions, lower end 166, pivot 158 and axis X9 may be adjacent the bottom of interior chamber 72, bottom edge 54 of sidewall 20/front wall 22 and ground 8, as well as adjacent and spaced rearwardly of inner surface 58 of front wall 22 and base segment 80 thereof and lower than surface 91 of segment 80. In the same lowered and closed positions, upper end 164, pivot 160 and axis X10 may be adjacent or within the front of interior chamber 72 and/or front wall opening 86 and higher than top surface 91 of base segment 80. Dumpster housing side door opening 76 may be forward of left and right linkage units 126 and 128 and the various components thereof and rearward of front linkage unit 130 and the various components thereof.

System 1 may further include actuators for moving the cover doors and front panel. More particularly, system 1 may include a first or left actuator 168 associated with left cover door 34, a second or right actuator 170 associated with right cover door 35, and a third or front actuator 172 associated with front panel 31. In the sample embodiment, each of actuators 168, 170 and 172 is in the form of a spring which may be a coil spring and more particularly may be a torsion spring. Thus for example, pivot 116 may be an axially elongated rod which extends through torsion spring 168, which may also be axially elongated. Likewise, pivot 117 may be an axially elongated rod which extends through torsion spring 170, which also may be elongated in the axial direction. Pivot 115 may be a longitudinally elongated rod which extends through torsion spring 172, which may be longitudinally elongated or elongated in the longitudinal direction. Spring 168 may be configured to apply an upward and leftward force to left cover door 34 in order to bias door 34 to or toward its open position. Similarly, spring 170 may be configured to apply an upward and rightward force to right cover door 35 to bias door 35 to or toward its open position. Similarly, spring 172 may apply a forward force on front panel 31 to bias panel 31 to or toward its extended position. As will be appreciated by one skilled in the art, other forms of springs may be used to bias or move the cover doors to their open position and the panel to its extended or deployed position. Likewise, other types of actuators (e.g., hydraulic, pneumatic or electric actuators) may be used for this purpose although springs provide a simple, low maintenance and relatively low cost option.

Figure 2:
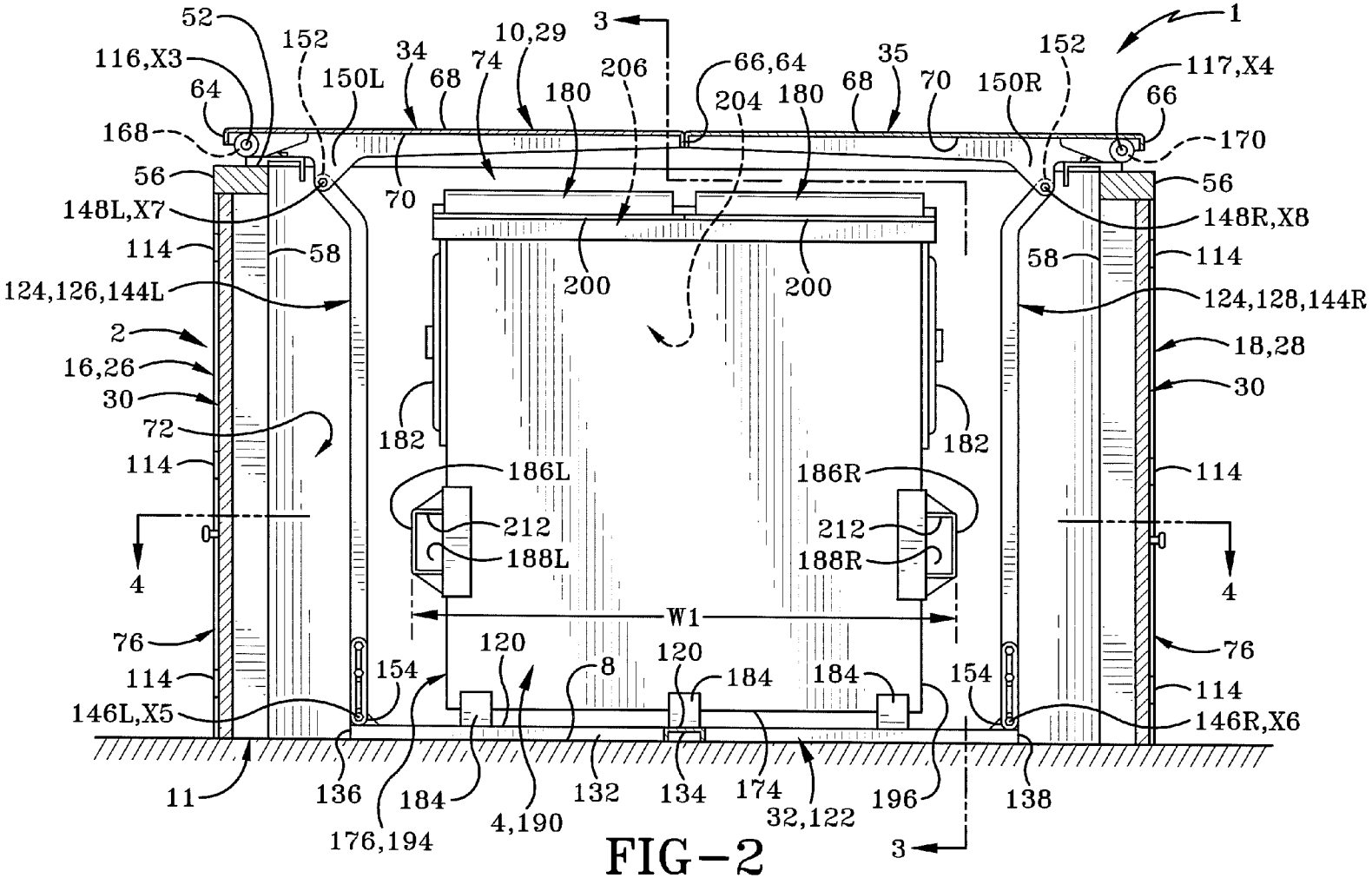
FIG. 2 is a view taken on line 2-2 of FIG. 1 looking rearwardly and providing a sectional view of the dumpster housing and a front elevation view of the dumpster in the dumpster housing.

With primary reference to FIGS. 2-4, dumpster 4 is now described in greater detail. Dumpster 4 may include a bottom wall 174, an upstanding sidewall 176 which is secured to and extends upwardly from bottom wall 174, a top wall 178 secured to the top of sidewall 176, a cover comprising one or more cover doors 180, a dumpster side door 182, a plurality of base ribs 184, and left and right channel members 186L and 186R defining left and right lift-receiving channels 188L and 188R. Bottom wall 174 may be essentially flat and essentially horizontal. Bottom wall 174 may be essentially square or rectangular as viewed from the bottom. Upwardly extending sidewall 176 may be essentially vertical and may include an upwardly extending front wall 190, an upwardly extending back wall 192, an upwardly extending left wall 194 and an upwardly extending right wall 196. Each of walls 190-196 may be essentially vertical walls and may be essentially flat. Front and back walls 190 and 192 may be essentially parallel to one another and extend in the longitudinal direction. Left and right walls 194 and 196 may extend in the axial direction and may be essentially parallel to one another and essentially perpendicular to walls 190 and 192. Front and back walls 190 and 192 may be essentially square or rectangular as viewed from the front or back, and left and right walls 194 and 196 may be essentially square or rectangular as viewed from the left or right sides. Top wall 178 may be essentially flat and horizontal and may be substantially rectangular as viewed from above.

Dumpster cover doors 180 may be movable relative to bottom wall 174, sidewall 176 and top wall 178 between dumpster cover door open and closed positions. Left and right doors 180 may be pivotally mounted on top wall 178 or sidewall 176 adjacent the top of sidewall 176 by a hinge or pivot 198 (FIG. 3) so that doors 180 may pivot about an axis X11 of pivot 198 between the open and closed positions (as represented by a double headed arrow in FIG. 3). Axis X11 may be essentially horizontal so that when dumpster 4 is within interior chamber 72 of housing 2 (or in any position during the removal of dumpster 4 from interior chamber 72 or insertion of dumpster 4 into interior chamber 72 or during the emptying of dumpster 4 into garbage truck 6) axis X11 may extend in the longitudinal direction and may be essentially parallel to axes X2, X9 and X10 and essentially perpendicular to axes X1 and axes X3-X8. Each dumpster cover door 180 may have a front end 200 and a back end 202. Pivot 198 may extend adjacent back ends 202 so that while back ends 202 remain adjacent pivot 198, front ends 200 may pivot upwardly and rearwardly from the closed position of doors 180 to the open position of doors 180 or forward and downwardly from the open position to the closed position of doors 180. Bottom wall 174 and sidewall 176 may define therein a dumpster interior chamber 204 which may also be referred to as a trash chamber or garbage chamber.

Chamber 204 may have a top entrance opening 206 which is covered by doors 180 in the closed position and uncovered when doors 180 are in the open position in order to provide access to interior chamber 204 from the top. Top entrance opening 206 may extend from the top edge of left wall 194 to the top edge of right wall 196 and may extend from the top edge of front wall 190 to the front edge of top wall 178. Entrance opening 206 may be substantially square or rectangular as viewed from above. Although dumpster 4 is shown with a top wall 178, dumpster 4 may be formed without a top wall 178 such that for instance top entrance opening 206 extends from the top edge of front wall 190 to the top edge of back wall 192 and such that pivot 198 and axis X11 extend along or adjacent the top edge of back wall 192.

Side door 182 may be movable between a closed position shown in solid lines and an open position shown in dashed lines. Upper and lower tracks 208 may be secured to and extend outwardly from sidewall 176 such that side door 182 is slidably mounted on tracks 208 to allow door 182 to move between the dumpster side door open and closed positions. Tracks 208 may be essentially parallel to one another, essentially horizontal and extend in the axial direction. Door 182 may slide linearly forward and rearward, and in the sample embodiment, the closed position may be a forward position and the open position may be a rearward position which is directly rearward of the closed position. Door 182 may also be pivotally mounted on sidewall 176 to move between open and closed positions. Sidewall 176 may define a through opening or trash opening 210 which is covered by side door 182 in its closed position and which is open when side door 182 is in its open position. Opening 210 may be a side trash opening 210 which is formed in one of left and right walls 194 and 196 such that opening 210 may extend from an outer surface to an inner surface of the given wall and provide communication between interior chamber 204 and atmosphere external to dumpster 4 or sidewall 176. In the sample embodiment, each opening 210 and door 182 may be along the same side as one of doorways 76 and doors 30 of housing 2 so that when dumpster 4 is within interior chamber 72 of housing 2, a given door 182 and opening 210 are easily accessible to a person walking through one of doorways 76 to allow easy access for insertion of trash into interior chamber 204 via opening 210. For instance, as shown in the sample embodiment, left opening 210 may be formed through left wall 194 and left door 182 may be movably or slidably mounted on left wall 194, while left opening 76 may be formed in left wall 26 of housing 2 and left door 30 may be movably mounted on left wall 26. Likewise, right opening 210 may be formed through right wall 196 and right door 182 may be movably or slidably mounted on right wall 196, while right opening 76 may be formed in right wall 28 of housing 2 and right door 30 may be movably mounted on right wall 28. When dumpster 4 is within interior chamber 72 of housing 2, opening 210 may be forward of left and right linkage units 126 and 128 and the various components thereof and rearward of front linkage unit 130 and the various components thereof.

Base ribs 184 may be rigidly secured to and extend downwardly from bottom wall 174 whereby downwardly facing surfaces of ribs 184 may define a bottom of dumpster 4 such that the bottom or other downwardly facing surface of dumpster 4 may be seated on dumpster seating or engagement surface 120 of linkage assembly 124. Left channel member 186L may be rigidly secured to and extend outwardly to the left from the leftward facing outer surface of left wall 194. Similarly, right channel member 186R may be rigidly secured to and extend outwardly to the right from the rightward facing outer surface of right wall 196. As is commonly known, channel members 186L and R may be positioned at essentially the same height such that channels 188L and R are likewise essentially at the same height. Channel members 186 and channels 188 may be essentially parallel to one another, essentially horizontal and elongated in the axial direction. Each channel member 186 may have a lift surface or lift engagement surface 212 which may be a downwardly facing surface which bounds or defines the top of the respective channel 188.

The left and right sides of dumpster 4 define therebetween a horizontal width W1 (FIG. 2) of dumpster 4 which may be less than distance D1 so that dumpster 4 may be removed upwardly from interior chamber 72 between open cover doors 34 and 35 and between edge 66 of left door 34 and edge 64 of right door 35 through open space 118. The left side of dumpster 4 may be defined by the leftmost portion of dumpster 4 and the right side of dumpster 4 may be defined by the rightmost portion of dumpster 4 such that the leftmost portion of dumpster 4 and the rightmost portion of dumpster 4 may define therebetween width W1. Left and right channel members 186L and 186R may respectively include the leftmost and rightmost portions of dumpster 4.

This paragraph describes relationships of various components which may exist when dumpster 4 is within interior chamber 72 (such as when dumpster 4, member 122 and linkage units 126, 128 and 130 are in their lowered positions). Front wall 192 of dumpster 4 may be spaced rearward of and generally adjacent front wall 22 of housing 2 with the forward facing front or outer surface of wall 190 facing the rearward facing back or inner surface 58 of front wall 22, back wall 192 of dumpster 4 may be spaced forward of and generally adjacent back wall 24 of housing 2 with the rearward facing back or outer surface of wall 192 facing the forward facing front or inner surface 58 of back wall 24, left wall 194 of dumpster 4 may be spaced to the right of and generally adjacent left wall 26 of housing 2 with the leftward facing outer surface of wall 194 facing the right ward facing inner surface 58 of left wall 26, right wall 196 of dumpster 4 may be spaced to the left of and generally adjacent right wall 28 of housing 2 with the rightward facing outer surface of wall 196 facing the leftward facing inner surface 58 of right wall 28, top wall 178 of dumpster 4 and dumpster cover doors 180 may be spaced downward of and generally adjacent cover 29/doors 34 and 35 of housing 2 with the upward facing top or outer surfaces of wall 178 and doors 180 facing the downward facing bottom or inner surface 70 of cover 29/doors 34 and 35, bottom wall 174 of dumpster 4 may be spaced upward of and generally adjacent ground 8 with the downward facing bottom surface of wall 174 facing the upward facing top surface of ground 8, and bottom wall 174 may be spaced upward of and adjacent or in contact with engagement surface 120 of member 122, and the bottom of dumpster 4 may be in contact with and seated on surface 120. Left linkage unit 126/link 144L may extend directly between left wall 26 of housing 2 and left wall 194 of dumpster 4, right linkage unit 128/link 144R may extend directly between right wall 28 of housing 2 and right wall 196 of dumpster 4, and front linkage unit 130/link 156 may extend directly between front wall 22 (segment 80/panel 31) of housing 2 and front wall 190 of dumpster 4. When dumpster 4 is seated on surface 120 of member 122 with dumpster 4 in its lowered position, the weight or downward gravitational force of dumpster 4 applied on member 122 may hold or keep member 122 and linkage units 126, 128 and 130 down in their lowered positions, and may hold or keep doors 34 and 35 in their closed positions, panel 31 in its home position and springs 168, 170 and 172 in their inactivated positions.

Referring now primarily to FIG. 5, garbage truck 6 may include a frame or chassis 214 and a plurality of ground-engaging wheels 215 rotatably mounted on frame or chassis 214 and rollingly engaging ground 8. Truck 6 may further include a trash receptacle 216 secured to chassis 214 extending upwardly therefrom generally along the central or rearward portion of the chassis, and a cab 218 secured and extending upwardly from the chassis 214 adjacent a front end thereof. Trash receptacle 216 is thus configured to receive trash dumped from interior chamber 204 of dumpster 4. Cab 218 is sized or configured to hold or accommodate therein a driver or operator 219 who may from within cab 218 control all the relevant operations of truck 6 discussed herein. Truck 6 may further include a lift 220 movably mounted on the chassis or other structure of truck 6 whereby lift 220 is capable of lifting dumpster 4 and dumping the contents or trash within dumpster 4 into trash receptacle 216 and lowering or otherwise moving dumpster 4 back to its place on or adjacent ground 8 within interior chamber 72 of housing 2 after dumping the trash therefrom.

Lift 220 may include left and right main lift arms 222L and 222R, as well as left and right forks or fingers or secondary arms 224L and 224R which are respectively movably mounted on left and right arms 222L and R. Truck 6 may further include a main arm actuator 226 and a fork actuator or finger actuator or second arm actuator 228. Arms 222 may be pivotally mounted on chassis 214 at respective left and right pivots 230. Forks 224 may be pivotally mounted respectively on arms 222 at respective left and right pivots 232 such that fork 224 may be pivotable relative to arms 222 about an essentially horizontal axis of pivots 232, and main arms 222 may be pivotable relative to chassis 214 about an essentially horizontal axis of pivot 230 which may be essentially parallel to the axis of pivot 232. These axes of pivots 230 and 232 may be longitudinally extending and essentially parallel to axes X2, X9, X10 and X11 when lift 220 is engaging dumpster 4 during the process of lifting, dumping and lowering dumpster 4.

The operation or methods related to the use of collection system 1 are now described in greater detail with primary reference to FIGS. 5-8. Before providing specific steps or processes, it is noted that dump truck 6 and lift 220 may, for instance, be operated as discussed in U.S. Pat. No. 6,123,497, which is incorporated herein by reference. In order to empty the trash from dumpster 4, operator or driver 219 may drive truck 6 forward (Arrow A) along ground 8 toward the front 12 of housing 2 in front of dumpster 4. Operator 219 while in cab 218 may have previously controlled actuators 226 and 228 in order to position arms 222 and 224 so that arms 222 may be generally in their forward position and arms or forks 224 may be in their lowered or generally horizontal position. As truck 6 rolls forward, left and right forks or arms 224L and 224R may be in an essentially horizontal orientation and may move essentially horizontally to be inserted (Arrow B) through left and right openings 88 and 90 respectively and then into left and right channels 188L and 188R of dumpster 4 while dumpster 4 is within interior chamber 72 seated on dumpster engagement surface 120 of member or support 122 and while cover 29/cover doors 34 and 35 are in the closed position and panel 31 is in the home position.

Once driver or operator 219 has driven truck 6 and/or moved forks 224 forward to insert forks 224 into channels 188 sufficiently, operator 219 may stop or park truck 6 at a stopped or parked position (FIGS. 5, 8) in which chassis 214, wheels 215, trash receptacle 216, cab 218 and operator 219 within cab 218 are in a position outside of and directly forward of housing 2 with the front of cab 218 and chassis 214 adjacent and spaced forward from the front surface of front wall 22 (or front surface 56 of portion 78 and front surface 104 of panel 31) and with panel 31 and front wall 22 directly between the front of truck 6/cab 218 and back wall 24 (when dumpster 4 is within chamber 72, front wall 22 /segment 80/panel 31 22 may be directly between the front of truck 6/cab 218 and dumpster 4). While truck 6 is in this stopped position (in which truck 6 may remain throughout the lifting, dumping and lowering of dumpster 4) with forks 224 within channels 188, operator 219 may appropriately control actuators 226 and/or 228 to raise forks or arms 224 upwardly such that the top of said forks engages respectively lift surfaces 212, and such that continuing upward movement (Arrows C in FIG. 6) of forks 224 and the front of arms 222 to pivot arms 222/forks 224 about pivot 230 begins lifting dumpster 4 upwardly within interior chamber 72 of housing 2. Prior to the lifting of dumpster 4, the weight of dumpster 4 or downward gravitational force thereof was applied to surface 120 of dumpster engagement member 122 so that as shown in FIGS. 1-5, member 122 was in its lowered position adjacent the bottom of interior chamber 72, linkage assembly 124 was in its lowered or home position, cover doors 34 and 35 were in their closed positions, panel 31 was in its home position, and springs or actuators 168, 170 and 172 were in inactivated positions.

As dumpster 4 is lifted within interior chamber 72, the weight or downward gravitational force of dumpster 4 which had been applied to member 122 is reduced and ultimately eliminated such that this reduction in weight or downward force applied to member 122 allows actuators or springs 168, 170 and 172 to move from their inactivated positions to their activated positions and to produce and apply sufficient force respectively to doors 34, 35 and panel 31 to move or pivot (Arrows D in FIGS. 6, 7) doors 34 and 35 from their closed positions (FIGS. 1-3, 5) to their open positions (FIG. 7) and to move or pivot (Arrow E in FIG. 8) panel 31 from its home position (FIGS. 1,3-5) to its deployed position (FIG. 8). During the movement of panel 31 from the home to the deployed position, top edge 96 may move closer to the front of truck 6/cab 218, and door 31 may contact the front of truck 6/cab 218 in the deployed position. As dumpster 4 is being raised or lifted and springs or actuators 168 and 170 are respectively applying force to doors 34 and 35 to open doors 34 and 35 via rotation or pivotal movement (Arrows D in FIGS. 6, 7) respectively about axes X3 and X4, the movement of doors 34 and 35 from their closed positions toward their open positions causes the lifting or upward movement (Arrows C in FIGS. 6,7) of left and right linkage units 126 and 128 via the pivotal connections 148 between the cover doors and links 144 of units 126 and 128. This upward movement of links 144 caused by the rotational movement of the cover doors and their corresponding mounting brackets 150 translates to the lifting or upward movement of member 122 via the pivotal connections 146 between links 144 and member 122. As doors 34 and 35 are pivoting or rotating upwardly about axes X3 and X4 respectively, left door 35 and bracket 150L may pivot (Arrow F in FIGS. 6, 7) relative to left link 144L at pivot 148L about axis X7, and right door 35 and mounting bracket 150R may pivot (Arrow G in FIGS. 6, 7) relative to right link 144R at right pivot 148R about axis X8. Also during this movement of the cover doors from their closed position towards their open positions and the raising of links 144, left link 144L may pivot (Arrow H in FIG. 7) relative to member 122 at pivot 146L about axis X5, and right link 144R may pivot (Arrow J in FIG. 7) relative to member 122 at pivot 146R about axis X6.

Also while dumpster 4 is moving upwardly within interior chamber 72 to reduce weight on member 122, and cover doors 34 and 35 are opening, front spring or actuator 172 may apply force to panel 31 to move panel 31 from the home position to the deployed position, which may involve the pivoting or rotational movement of door 31 about pivot 115 and axis X2. This pivotal movement about axis X2 of panel 31 and bracket 162 may cause the lifting or upward movement (Arrow K in FIG. 8) of linkage unit 130 and the pivotal movement (Arrow L in FIG. 8) of panel 31 and bracket 162 relative to link 156 via the pivotal connection at pivot 160 about axis X10. The upward movement of link 156 may also cause the pivotal movement (Arrow M in FIG. 8) of link 156 relative to member 122 about the pivot connection at pivot 158 about axis X9. During the opening of panel 31 and corresponding movement of other components noted above, pivot 160 may slide within slot 163 from adjacent the back/lower end of slot 163 toward the front/upper end of slot 163, for instance, while panel 31 rests against the front of cab 218/truck 6.

It is noted here that while the weight of dumpster 4 is pressing downwardly on member 122 to hold member 122 and linkage assembly 124 in their lowered positions, doors 34 and 35 in their closed positions and panel 31 in its home position, actuators or springs 168, 170 and 172 may not be capable of applying a sufficient force to overcome this weight and thus move member 122 and linkage assembly 124 to their raised positions, doors 34 and 35 to their open positions and panel 31 to its deployed position, but that actuators or springs 168, 170 and 172 may be capable of applying a sufficient force to so move these components when the dumpster weight is removed from member 122. It is further noted that once dumpster 4 is removed from member 122, doors 34 and 35 may remain in their open positions and panel 31 in its deployed position absent another force acting on them by virtue of the actuators/springs biasing them in one direction (toward open/deployed positions) and the weight of member 122 and linkage assembly 124 simultaneously biasing them in a second opposite direction (toward closed/home positions). Housing 2 may also be provided with stops which limit the movement of doors 34 and 35 beyond open positions such as those shown in FIG. 7 in which doors 34 and 35 are upwardly extending. That is, such movement may be limited by one or more stops, such as on sidewall 20 or the given door, or in other suitable locations. Links 144L and 144R may engage left and right walls 26 and 28 to provide such stops as well.

Operator 219 may continue to control actuators 226 and 228 in order to further lift dumpster 4 off of/out of contact with surface 120/member 122 (as shown in FIG. 8) and out of interior chamber 72 to pass through space 118 and between doors 34 and 35 in the open positions thereof. During the raising or lifting of forks 224 and dumpster 4, left and right forks 224L and 224R respectively move upwardly within left and right openings 88 and 90 while extending through the front and back entrance openings 110 and 112 of respective openings 88 and 99, and continue to move upwardly to pass out of or exit openings 88 and 90 through the tops or top entrance openings 108 so that forks 224 may be directly above entrance openings 108 and openings 88 and 90. As dumpster 4 is being lifted out of interior chamber 72, the lower front horizontal corner of dumpster 4 adjacent the bottom of front wall 190 and the front of bottom wall 174 may pass through an upper portion of front wall opening 86 (where top edge 96 was in the home position) while panel 31 is in the deployed position and dumpster 4 may pass over top edge 96 of panel 31 in the deployed position. Once dumpster 4 has been removed from interior chamber 72, operator 219 continues the control of arms 222 and 224 via actuators 226 and 228 as known in the art to dump (Arrow N in FIG. 8) the trash from dumpster 4 into receptacle 216. During this movement, dumpster 4 and forks 224 move forward relative to housing 2 and rearward relative to truck 6 such that forks 224 may be entirely forward of front wall 22 and openings 88 and 90. After dumping the trash from dumpster 4, operator 219 may control the actuators to move arms 222 and 224 (forward relative to truck 6 and rearward relative to housing 2) and downwardly to reinsert (opposite Arrow N and Arrows C) dumpster 4 back into interior chamber 72. During this reinsertion process, the front lower corner of dumpster 4 noted above may pass over top edge 96 of panel 31 in the deployed position and may also pass through opening 86 before entering chamber 72. Also during this reinsertion, forks 224 may move rearwardly into a position directly above openings 88 and 90, then downwardly into openings 88 and 90 through top entrance openings 108 thereof.

Figure 6:
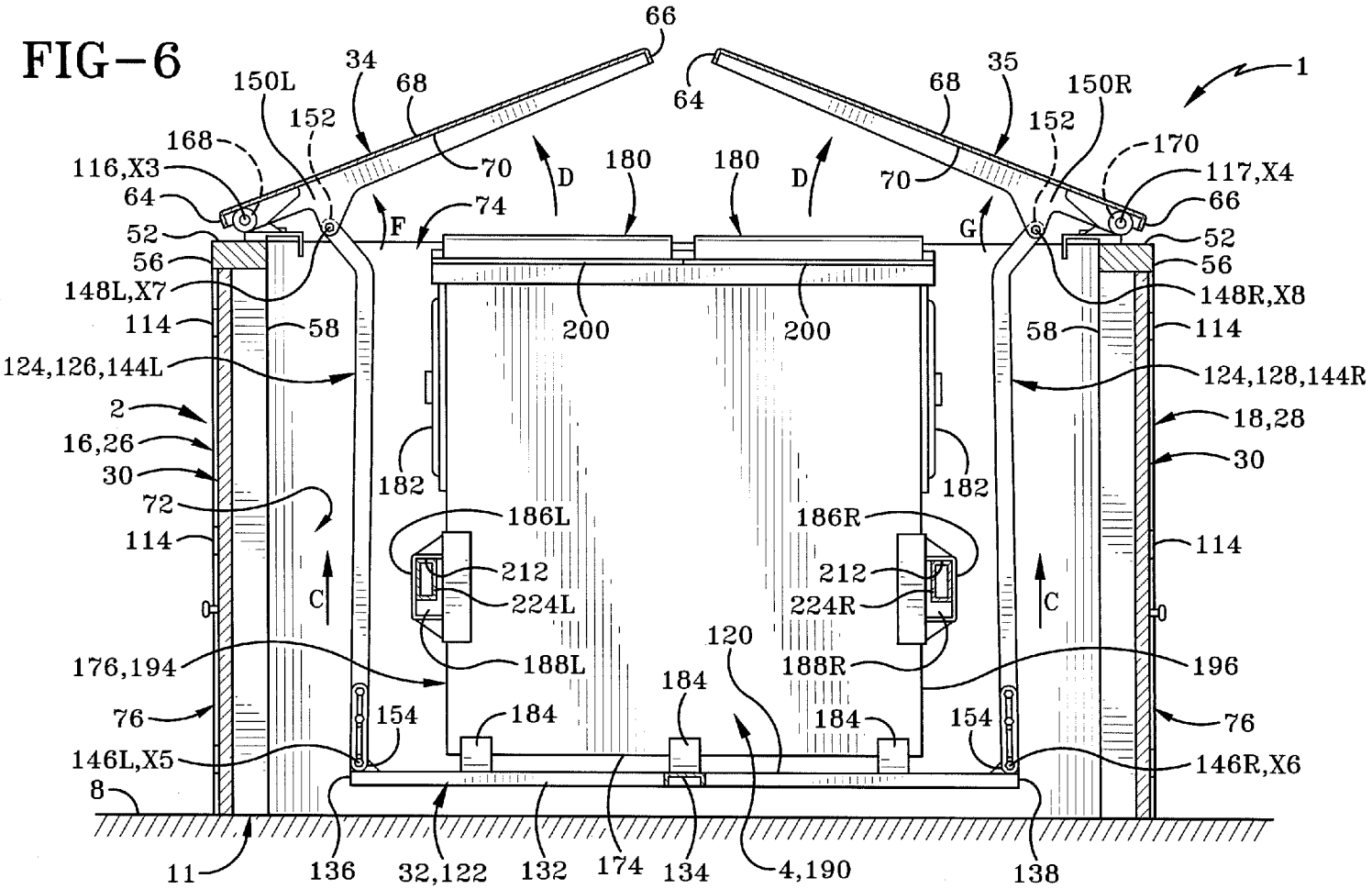
FIG. 6 is a view similar to FIG. 2 showing an initial stage of lifting the dumpster such that the dumpster has been lifted a short vertical distance, such that the cover doors have begun to open, and such that the left and right linkage units and dumpster engagement member have moved upwardly a short vertical distance.

As dumpster 4 is lowered (opposite Arrows C in FIGS. 6-7) within chamber 72 of housing 2, the bottom thereof may again contact surface 120 of member 122 (as shown in FIGS. 6-7), thereby applying the weight or downward gravitational force of dumpster 4 on member 122 such that member 122 is forced or pushed downwardly, thereby also effecting the downward movement of linkage units 126, 128 and 130 and the closing rotational movement (opposite Arrows D in FIGS. 6, 7) of cover doors 34 and 35 about axes X3 and X4 and the closing or retracting movement (opposite Arrow E in FIG. 8) of panel 31 from the deployed to the home position about axis X2. The downward force of dumpster 4 on member 122 may thus be translated to links 144 via pivots 146 and in turn to doors 34 and 35 and brackets 150 via pivots 148 to cause the rotational movement of doors 34 and 35 to move from the open position to the closed position. During this downward movement of the various components noted, the cover doors may pivot respectively relative to links 144 respectively about pivots 148 (opposite Arrows F and G in FIGS. 6, 7), and links 144 may respectively pivot relative to member 122 about pivots 146 (opposite Arrows H and J in FIGS. 6, 7). Also during the downward movement of dumpster 4 to cause the downward movement of member 122, the downward movement of member 122 is translated to the downward movement (opposite Arrow K in FIG. 8) of link 156 and the pivotal movement (opposite Arrow E in FIG. 8) of panel 31 about axis X2 to move panel 31 from the deployed position to the home position, during which panel 31 and bracket 162 may pivot (opposite Arrow L in FIG. 8) relative to link 156 about axis X10 and link 156 may pivot (opposite Arrow M in FIG. 8) relative to member 122 about axis X9. As the weight of dumpster 4 forces member 122 and linkage assembly 124 down, this force may be translated to a downward force on cover doors 34 and 35 and a rearward force on front panel 31 via the corresponding linkage units 126, 128 and 130 which overcomes the spring bias of springs 168, 170 and 172 to move the cover doors and front panel to their closed and home positions.

Once the operator 219 has lowered dumpster 4 all the way down so that member 122 is in its lowered position with dumpster 4 seated thereon within interior chamber 72 and with doors 34 and 35 in their closed positions and panel 31 in its home position (as shown in FIGS. 5, 6), the operator may back up (opposite Arrow A in FIG. 8) truck 6 to move the truck away from the front of housing 2 and to remove (opposite Arrow B in FIG. 8) forks 224 from within channels 188 and openings 88 and 90. Like the insertion of forks 224 into and through openings 88 and 90 and channels 188, the removal of the forks from said channels and openings may occur as forks 224 move essentially horizontally in the axial direction of housing 2 and while forks 224 are in an essentially horizontal orientation. All of the above-noted steps or operations may occur while the operator 219 is outside of housing 2 and within cab 218, and thus without operator 219 contacting or coming into contact housing 2, which may mean, for instance, without manually manipulating any component of housing 2. Thus, the driver or operator 219 need not exit cab 218 in order to accomplish all these steps or operations. Thus, housing 2 may provide a desirable aesthetic appearance and also allow for the emptying of dumpster 4 while the operator of garbage truck 6 remains in the cab, thereby eliminating the need for the driver or operator to exit the truck to open a garbage truck access gate of a fenced in area or dumpster housing before emptying the trash from dumpster 4 and/or closing such a gate of a fenced in area or dumpster housing after emptying the dumpster.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

What is claimed is:

1. An apparatus comprising:

a dumpster housing having a sidewall which defines a dumpster-receiving interior chamber and has a top edge defining a top entrance opening of the interior chamber;

left and right lift-receiving through openings which are formed in the sidewall in communication with the interior chamber and atmosphere outside the housing, which extend downwardly from the top edge of the sidewall and which are adapted to respectively receive therethrough left and right forks of a lift; and a housing cover which is movably mounted on the sidewall to move between an open position and a closed position in which the cover extends over the top entrance opening.

2. The apparatus of claim 1 further comprising a dumpster engagement member within the interior chamber having a dumpster engagement surface.

3. The apparatus of claim 2 wherein the dumpster engagement surface moves upwardly in response to movement of the cover from the closed position to the open position.

4. The apparatus of claim 2 wherein the dumpster engagement surface is adjacent a bottom of the interior chamber.

5. The apparatus of claim 1 further comprising a dumpster engagement member within the interior chamber; and a linkage assembly extending between the dumpster engagement member and the cover.

6. The apparatus of claim 1 further comprising a first cover door of the housing cover;

and a first linkage unit which extends within the interior chamber and is pivotally connected to the first cover door.

7. The apparatus of claim 6 further comprising a dumpster engagement member which is within the interior chamber and pivotally connected to the first linkage unit.

8. The apparatus of claim 7 further comprising a second cover door of the housing cover; and a second linkage unit which extends within the interior chamber, which is pivotally connected to the second cover door and which is pivotally connected to the dumpster engagement member.

9. The apparatus of claim 1 further comprising a spring which biases the cover toward the open position.

10. The apparatus of claim 1 further comprising an actuator which is operatively connected to the cover so that the cover moves from the closed position to the open position in response to a force produced by the actuator.

11. The apparatus of claim 1 wherein the housing cover comprises first and second cover doors which are movable relative to the sidewall and one another.

12. The apparatus of claim 1 further comprising a dumpster support which hangs from the cover in the interior chamber.

13. The apparatus of claim 1 further comprising:

a dumpster engagement member within the interior chamber adapted to engage the dumpster; and a linkage unit operatively connected to the cover and dumpster engagement member such that the dumpster engagement member moves in response to movement of the cover between the open and closed positions.

14. An apparatus comprising:

a dumpster housing having a sidewall which defines a dumpster-receiving interior chamber and has a top edge defining a top entrance opening of the interior chamber;

left and right lift-receiving through openings which are formed in the sidewall in communication with the interior chamber and atmosphere outside the housing, which extend downwardly from the top edge of the sidewall and which are adapted to respectively receive therethrough left and right forks of a lift; and wherein the sidewall comprises a sidewall portion and a front panel which is mounted on the sidewall portion between the left and right through openings and movable relative to the sidewall portion between a home position and a deployed position.

15. The apparatus of claim 14 further comprising a dumpster engagement member within the interior chamber which moves upwardly in response to movement of the front panel.

16. The apparatus of claim 14 further comprising a dumpster engagement member within the interior chamber; and a linkage unit extending between and operatively connected to the dumpster engagement member and front panel.

17. The apparatus of claim 14 wherein the panel has a top edge which in the deployed position is at least one of forward of and lower than the top edge in the home position.

18. The apparatus of claim 14 further comprising a linkage unit extending within the interior chamber and pivotally connected to the front panel.

19. An apparatus comprising:

a dumpster housing defining a dumpster-receiving interior chamber which is adapted to house therein a dumpster;

a front panel of the dumpster housing which is movable between a home position and a deployed position;

a dumpster engagement member within the interior chamber adapted to engage the dumpster; and a linkage unit operatively connected to the front panel and dumpster engagement member such that the dumpster engagement member moves in response to movement of the front panel between the home and deployed positions.

* * * * *